US010150024B1

(12) United States Patent
Esparza

(10) Patent No.: US 10,150,024 B1
(45) Date of Patent: Dec. 11, 2018

(54) VEHICLE-MOUNTED EXERCISE SYSTEM

(71) Applicant: Jose I Esparza, Orlando, FL (US)

(72) Inventor: Jose I Esparza, Orlando, FL (US)

( * ) Notice: Subject to any disclaimer, the term of this patent is extended or adjusted under 35 U.S.C. 154(b) by 10 days.

(21) Appl. No.: 15/405,119

(22) Filed: Jan. 12, 2017

Related U.S. Application Data

(60) Provisional application No. 62/278,504, filed on Jan. 14, 2016.

(51) Int. Cl.

| | |
|---|---|
| ***A63B 71/00*** | (2006.01) |
| ***A63B 21/06*** | (2006.01) |
| ***A63B 21/00*** | (2006.01) |
| *B60R 11/00* | (2006.01) |

(52) U.S. Cl.
CPC ..... *A63B 71/0036* (2013.01); *A63B 21/0602* (2013.01); *A63B 21/154* (2013.01); *A63B 21/4027* (2015.10); *A63B 21/4029* (2015.10); *A63B 2210/50* (2013.01); *B60R 2011/004* (2013.01); *B60R 2011/0082* (2013.01)

(58) Field of Classification Search
CPC . A63B 21/06; A63B 21/0601; A63B 21/0602; A63B 21/062; A63B 21/023; A63B 21/025; A63B 21/4027; A63B 21/4029; A63B 21/4031; A63B 21/15–21/156; A63B 71/0036
See application file for complete search history.

(56) References Cited

U.S. PATENT DOCUMENTS

| | | | | | |
|---|---|---|---|---|---|
| 2,378,460 | A * | 6/1945 | Bingham | B60D 1/167 | 280/446.1 |
| 2,918,282 | A * | 12/1959 | Waterval | A63B 21/06 | 248/205.9 |
| 3,982,755 | A * | 9/1976 | Sarich | A63B 23/14 | 482/46 |
| 4,072,308 | A * | 2/1978 | Applegate | A63B 21/0602 | 482/46 |
| 4,084,815 | A * | 4/1978 | Flannery | A63B 21/06 | 482/131 |
| 4,109,907 | A * | 8/1978 | Zito | A63B 21/06 | 482/904 |
| 4,634,127 | A * | 1/1987 | Rockwell | A63B 23/03525 | 297/118 |
| 4,674,484 | A * | 6/1987 | Kott | A63B 21/0602 | 248/164 |

(Continued)

*Primary Examiner* — Nyca Y Nguyen
(74) *Attorney, Agent, or Firm* — H. John Rizvi; Gold & Rizvi, P.A.

(57) ABSTRACT

A vehicle-mounted exercise system is disclosed for use by long distance truck drivers to maintain themselves in shape while on the road and includes a main frame that is secured to the bed or frame of a truck by a mounting system. The exercise system includes an exercise mechanism having puller device a cable connected to the puller device and passing over a series of pulleys on the main frame to a pull down or lat bar. The puller device can be a hollow container or a spring-biased mechanism. The hollow container can be filled with water. A sight window and weight-indicating indicia along one side of the container assist in setting the correct weight in the container. A foldable seat assembly is mounted to the main frame and can be moved between a first or stored position for transportation and final or deployed position for use.

16 Claims, 10 Drawing Sheets

(56) References Cited

U.S. PATENT DOCUMENTS

| | | | | |
|---|---|---|---|---|
| 4,826,157 | A * | 5/1989 | Fitzpatrick | A63B 21/078 482/103 |
| 5,242,352 | A * | 9/1993 | Elliott | A63B 21/06 472/128 |
| 5,558,608 | A * | 9/1996 | Hall | A63B 21/0552 482/129 |
| 6,099,441 | A | 8/2000 | Bonnet | |
| 6,159,133 | A | 12/2000 | Shugg | |
| 6,758,795 | B2 | 7/2004 | Barber | |
| 7,229,392 | B2 | 6/2007 | Turnbull et al. | |
| 8,485,951 | B1 | 7/2013 | Adams | |
| 9,320,934 | B1 * | 4/2016 | Pringle | A63B 23/03558 |
| 2003/0114281 | A1 * | 6/2003 | Mackert | A63B 21/00 482/123 |
| 2004/0033866 | A1 * | 2/2004 | Shapiro | A63B 21/06 482/93 |
| 2005/0032614 | A1 * | 2/2005 | Keiser | A63B 21/4029 482/142 |
| 2007/0228693 | A1 * | 10/2007 | Witchey | B60D 1/07 280/416.1 |
| 2007/0259764 | A1 | 11/2007 | Kelly | |
| 2010/0173759 | A1 | 7/2010 | Lalaoua | |
| 2011/0281697 | A1 * | 11/2011 | Reyes | A63B 21/062 482/97 |
| 2014/0296037 | A1 * | 10/2014 | Razzaq | A63B 21/16 482/54 |
| 2015/0141220 | A1 * | 5/2015 | Wargo | A63B 21/0602 482/139 |

* cited by examiner

VEHICLE-MOUNTED EXERCISE SYSTEM

CROSS-REFERENCE TO RELATED APPLICATIONS

This application claims the benefit of U.S. Provisional Patent Application Ser. No. 62/278,504, filed on Jan. 14, 2016, which is incorporated herein in its entirety.

FIELD OF THE INVENTION

The present invention relates generally to portable weight training devices and, more particularly, to a vehicle-mounted exercise system for use by truck drivers while on the road.

BACKGROUND OF THE INVENTION

It is important in many long distance travelling occupations to find time and a place to exercise to maintain body strength and tone. This is particularly true for long distance truck drivers who spend a majority of their time on the road and in a seated position. This can lead to back and other body troubles. The situation is further exacerbated by the fact that truck drivers need to personally be able to handle heavy weight equipment while loading and unloading their cargo.

Various types of weight systems are available for use on the road. Some of these systems require multiple resistance cables or ropes which are difficult to calibrate to a specific weight or level of resistance. Other systems require multiple heavy weights to be transported along with the basic system itself taking up space in truck drivers cab or living quarters and adding additional weight to the tractor portion of the truck, thus reducing the maximum cargo weight that can be transported by the tractor portion.

Accordingly, there is an established need for a portable weight training system that solves at least one of the aforementioned problems and provides a convenient and simple to use exercise equipment for truck drivers while on the road, and particularly for long range truck drivers.

SUMMARY OF THE INVENTION

A vehicle-mounted exercise system is disclosed for use by long distance truck drivers to maintain themselves in shape while on the road and includes a main frame that is secured to the bed or frame of a truck by a mounting system. The exercise system includes an exercise mechanism having puller device a cable connected to the puller device and passing over a series of pulleys on the main frame to a pull down or lat bar. The puller device can be a hollow container or a spring-biased mechanism. The hollow container can be filled with water. A sight window and weight-indicating indicia along one side of the container assist in setting the correct weight in the container. A foldable seat assembly is mounted to the main frame and can be moved between a first or stored position for transportation and final or deployed position for use.

In a first implementation of the invention, a vehicle exercise system for use on a motor vehicle comprises a main frame, a mounting system, at least one pulley, a cable portion and a puller device. The mounting system secures the main frame to a portion of a motor vehicle. Each pulley of the at least one pulley is carried by the main frame and is individually rotatable relative to the main frame. In turn, a first end of the cable portion is attached to the puller device, while an opposite, second end of the cable portion is attached to a bar. The cable portion passes over the at least one pulley in a reciprocally back-and-forth movable manner. The puller device is configured to provide a resistance to an upward pulling of the cable portion on the puller device responsive to a pulling of the bar at the second end of the cable portion.

In a second aspect, the puller device can include a hollow container suspended from the cable portion. The container can carry out a dual function of providing additional storage space and allowing the user to adjust the strength of the exercise device.

In another aspect, the container can include at least one drain hole at or near a bottom side of the hollow container. Thus, if the user fills the container with water to adjust the container weight (and, consequently, the strength of the device), the user can easily empty the container when finished exercising.

In another aspect, the container can include a see-through window revealing a level of contents contained within the container, to facilitate adjusting the weight of the container.

In yet another aspect, the container can include outer visible markings, wherein each marking is indicative of a respective total weight of the container and a corresponding specific water level of a specific amount of water contained within the container.

In another aspect, the puller device can include an extension-spring-biased system, secured between the main frame and the first end of the cable portion. The extension-spring-biased system can be configured to exert a pulling force on the first end of the cable portion responsive to a pulling force exerted by the first end of the cable portion on the extension-spring-biased system.

In another aspect, the puller device is disconnectably attached to the first end of the cable portion, such as to facilitate draining water from inside the container (in the event that the puller device comprises a hollow container) or cleaning the puller device. Alternatively, the puller device can be non-disconnectably attached to the first end of the cable portion.

In yet another aspect, the vehicle exercise system can include a seat assembly providing a seating surface for a user of the vehicle exercise system. Preferably, the user can choose to train in either a sitting position or a standing position.

In another aspect, the seat assembly can be pivotably attached to the main frame and configured to adopt a horizontal, seating position and to further adopt a storage position pivoted away from the seating position.

In another aspect, the seat assembly can include a primary seat section pivotably attached to the main frame and a secondary seat section pivotably carried by the primary seat section.

In another aspect, the vehicle exercise system can include an extension arm pivotably carried by the main frame at a top area thereof. A pulley is rotatably carried by the extension arm. The vehicle exercise system can adopt a storage position in which the seat assembly is pivoted upward and locked in place by the extension arm.

In yet another aspect, the vehicle exercise system can adopt an operational position in which the seat assembly is pivoted downward relative to the storage position and provides a seating surface for a user of the vehicle exercise system.

In another aspect, in the operational position of the vehicle exercise system, the extension arm can be arranged in an upward-pivoted position relative to the storage position.

In another aspect, in the operational position of the vehicle exercise system, the extension arm can be locked in place by an axle located beneath the extension arm and supporting the extension arm.

In yet another aspect, the axle can be removable from underneath the extension arm.

In another aspect, the seat assembly can include at least one pivotable bottom support, the bottom support configured to pivot relative to a seating portion of the seat assembly between an operational position in which the bottom support holds at least part of the weight of the seating portion and a storage position in which the bottom support is pivoted closer to the seating portion than in the operational position.

In another aspect, the mounting system can include a U-shaped bracket for engaging a portion of a rail of a vehicle frame. The U-shape bracket can be attachable to the main frame of the vehicle exercise system for enclosing the portion of a rail therewithin and securing the vehicle exercise system to the portion of a rail.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a vehicle-mounted exercise system that is collapsible for storage and transportation and allows truck drivers to exercise and stay in shape while on the road.

Figure 1:
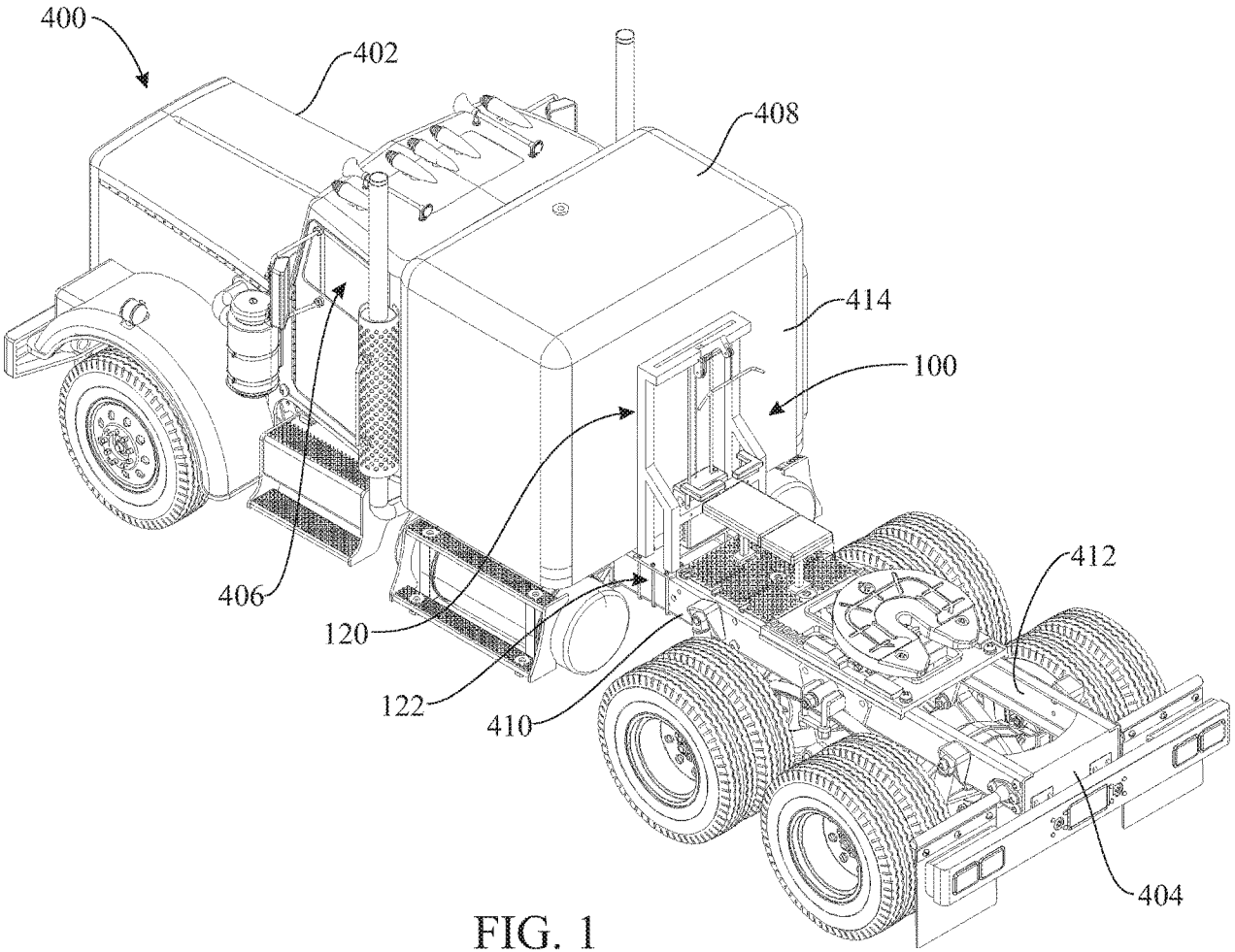
FIG. 1 presents an isometric view of one embodiment of a vehicle-mounted exercise system mounted on a truck.
Figure 2:
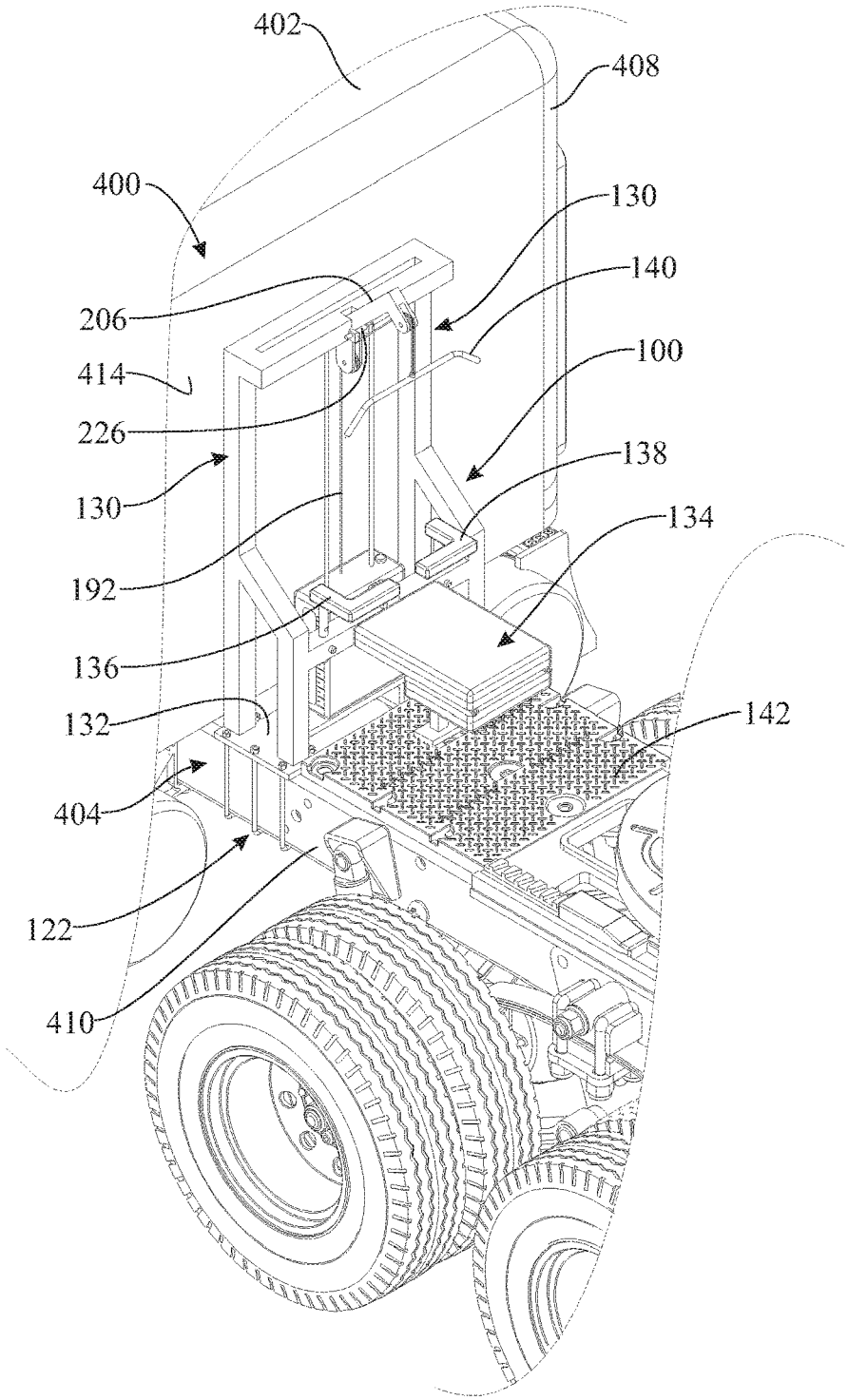
FIG. 2 presents an enlarged isometric view of the vehicle-mounted exercise system.

Referring initially to FIGS. 1 and 2, a vehicle-mounted exercise system 100 is illustrated in accordance with an exemplary embodiment of the present invention. As shown, the exercise system 100 is mounted on a long-distance type vehicle, such as, for example, truck 400. In this illustrative application of the exercise system 100, truck 400 is of the semi-tractor trailer variety including an engine and driver cab 402 mounted on a truck frame 404. The cab 402 includes a driver compartment 406 and an attached traveling quarters 408 for storage of clothing and other necessities, as well as providing a short term sleeping location for a driver.

The exercise system 100 includes a main frame 120 and a mounting system 122 to attach the main frame 120 to the truck 400. The mounting system 122 is securely connected to opposed side beams or rails 410 and 412 of the truck frame 404, in a manner described in more detail hereinbelow. The exercise system 100 is positioned against a back wall 414 of the travelling quarters 408 of the cab 402 of the truck 400, facing rearward. This allows the exercise system 100 to conveniently be carried on the truck 400 in an out-of-the-way position and not take up space within the interior of the cab 402.

With reference to FIG. 2, the exercise system 100 further generally includes an exercise mechanism 130 positioned within the main frame 120 of the exercise system 100 and a base plate 132 for support of the main frame 120 on the rails 410 and 412 of the truck frame 404 of the truck 400. The base plate 132 can be rectangular, I-shaped (as shown) or present any other applicable shape. A movable seat assembly 134 is provided for the convenience and comfort of a user and is movably mounted to the main frame 120 of the exercise system 100 for transportation and storage. Similarly, a pair of leg rests 136 and 138 are also movably mounted to the main frame 120 for the convenience and comfort of the user and further serve to secure the seat assembly 134 in a stored position (see FIG. 6) when not in use.

The exercise mechanism 130 includes a pull-down or lat bar 140 to operate the exercise mechanism 130 in either a seated position on the seat assembly 134 or in another position such as, for example, kneeling, standing, etc. when the user is not seated on the seat assembly 134. Preferably, the exercise system 100 includes a non-slip surface or floor 142, mounted across the rails 410 and 412 of the truck frame 404 and adjacent the main frame 120 of the exercise system 100, to prevent the user from falling and/or injury during operation of the exercise mechanism 134 and while not seated on the seat assembly 134.

Figure 3:
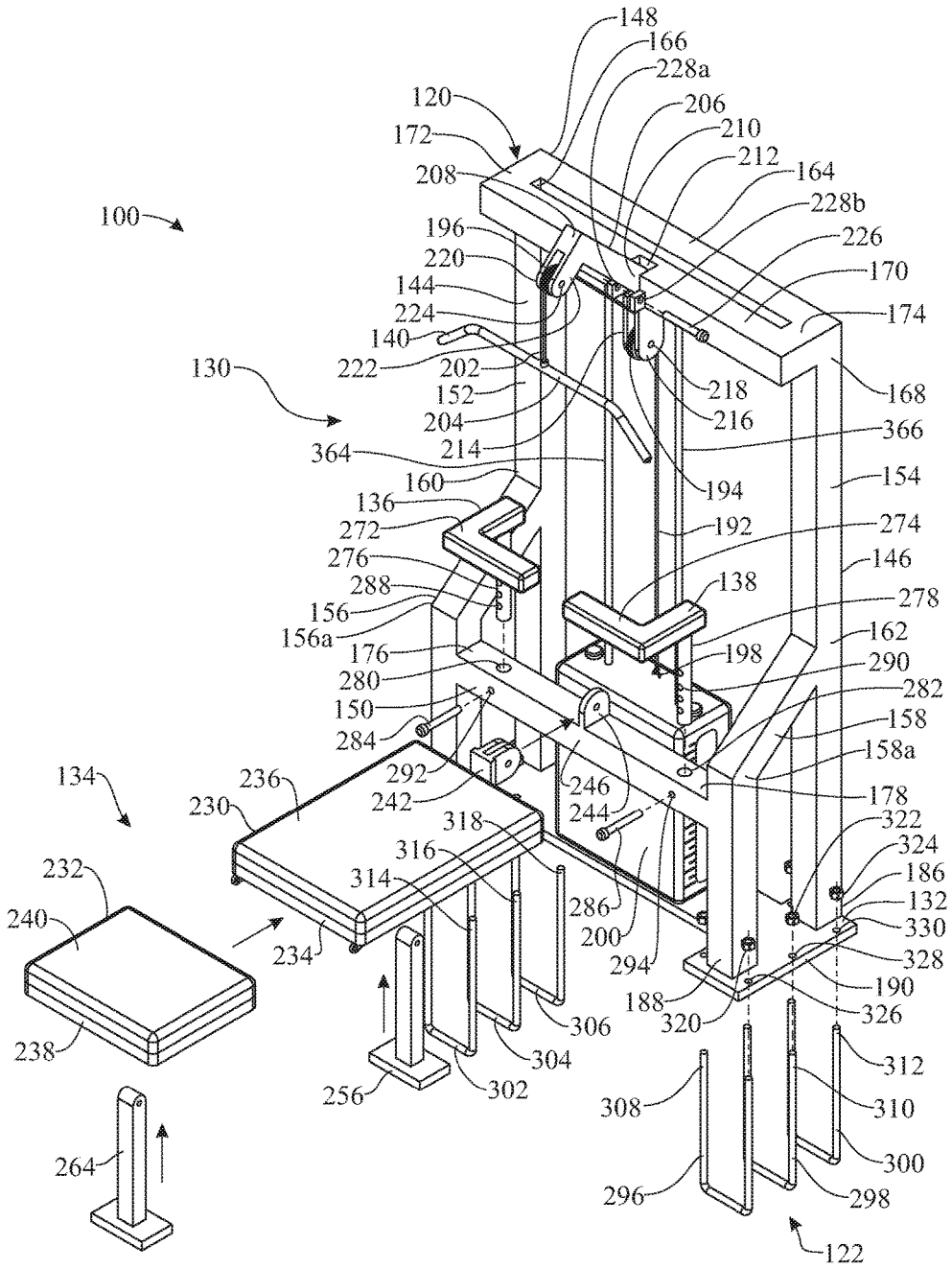
FIG. 3 presents an isometric view, with parts separated, of the vehicle-mounted exercise system of FIG. 1.
Figure 6:
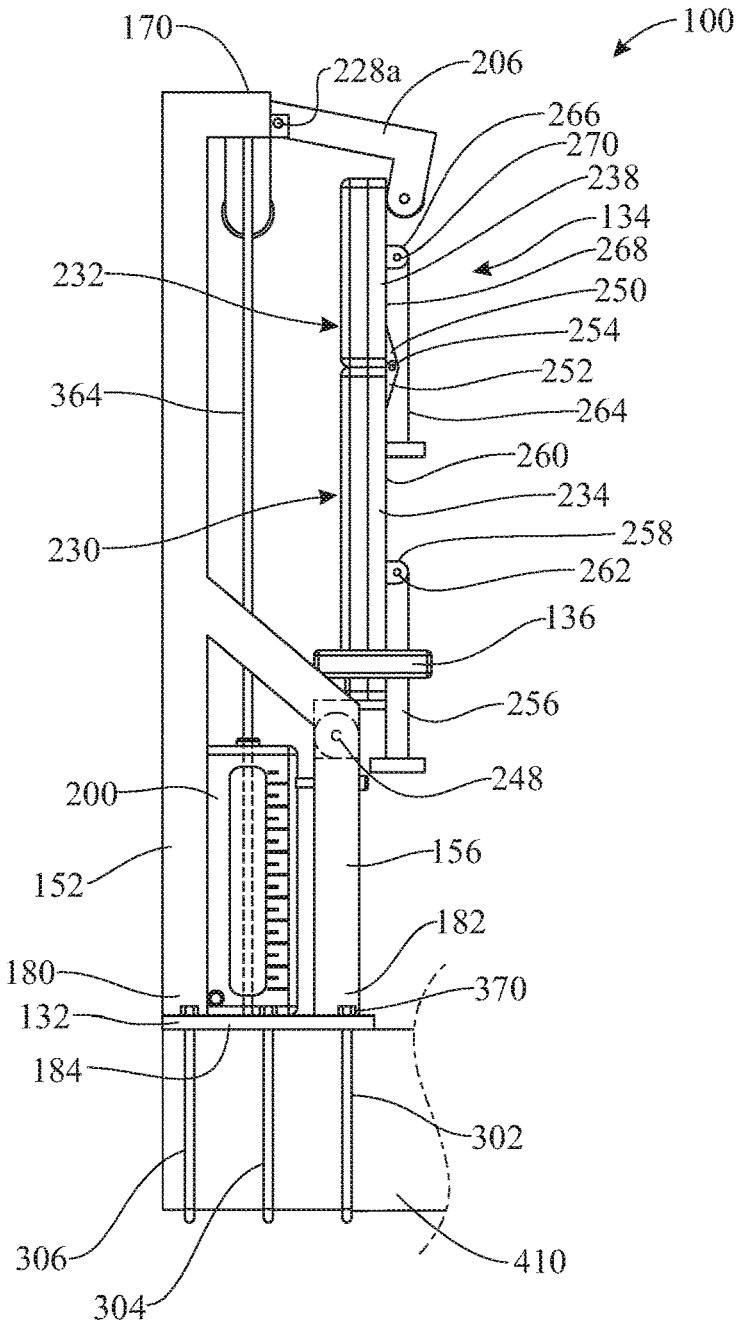
FIG. 6 presents a side elevation view of the vehicle-mounted exercise system in a collapsed or first position for transportation and storage.

Referring now to FIG. 3, the exercise system 100 is illustrated with its component parts separated or in exploded format. As shown, the main frame 120 forms the foundation of the exercise system 100 and generally includes a pair of upright h-shaped side supports 144 and 146 and a top cross-bar assembly 148 extending between the side supports 144 and 146. A second or frontal cross-bar 150 also extends between the side supports 144 and 146 to further strengthen the main frame 120. Specifically, each upright h-shaped side support 144 and 146 includes a respective main vertical beam 152 and 154 and an angled frontal leg 156 and 158 extending forward and from a respective approximate mid-point 160 and 162 on the main vertical beam 152 and 154. The top cross-bar assembly 148 includes a rear cross bar 164 extending across and affixed to top ends 166 and 168 of the side supports 144 and 146 and a front cross-bar 170 extending forward of the rear cross-bar 164 and affixed thereto by side bars 172 and 174. The frontal cross-bar 150 extends between the angled front legs 156 and 158 such that a first end 176 of the frontal cross-bar 150 is connected to the angled frontal leg 156 at a position just below a "knee" 156*a* of the angled frontal leg 156. Similarly, a second end 178 of the frontal cross-bar 150 is connected to the angled frontal leg 158 at a position just below a "knee" 158*a* of the angled frontal leg 158. Finally, the side supports 144 and 146 extend upward from and are connected to the base plate 132. Specifically, as shown in FIG. 6, bottom ends 180, 182 of the main vertical beam 152 and the angled frontal leg 156 are connected to a first end 184 of the I-shaped base plate 132 and, as shown in FIG. 3, bottom ends 186 and 188 of the main vertical beam 154 and angled frontal leg 158 are connected to a second end 190 of the I-shaped base plate 132.

The main frame 120 may be formed from the individual sections just described and connected together by welding, bolting, riveting or other known method of connecting like metals together. Alternatively, the sections of the main frame 120 may be formed integrally by casting, molding or other known metalworking methods. The bottom ends 180 and 186 of the main vertical beams 152 and 154 and the bottom ends 182 and 188 of the angled frontal legs 156 and 158 can be affixed by to the base plate 132 by welding, bolting, riveting, pinning, etc. The main frame 120 can be formed from a variety of materials including, for example, stainless steel, iron, etc. In order to reduce weight on the truck 400, the main frame 120 may alternatively be formed from high strength cast or tubular aluminum, for instance and without limitation. Combinations of different materials are also envisaged.

With continued reference to FIG. 3, as noted hereinabove the exercise mechanism 130 includes a lat bar 140 for activating and operating the exercise mechanism 130. The exercise mechanism 130 additionally includes a detachable cable 192 which extends over a first pulley 194, and second pulley 196. The detachable cable 192 is removably connected at second or detachable end 198 to a movable, hollow, weight-adjustable container 200 in a manner described in more detail hereinbelow. A first or primary end 202 of the detachable cable 192 is affixed to a mid-point 204 of the lat bar 140. Pulling on the lat bar 140 by a user draws the detachable cable 192 over the first and second pulleys 194 and 196 to raise and lower the container 200 to perform various exercises.

Figure 7:
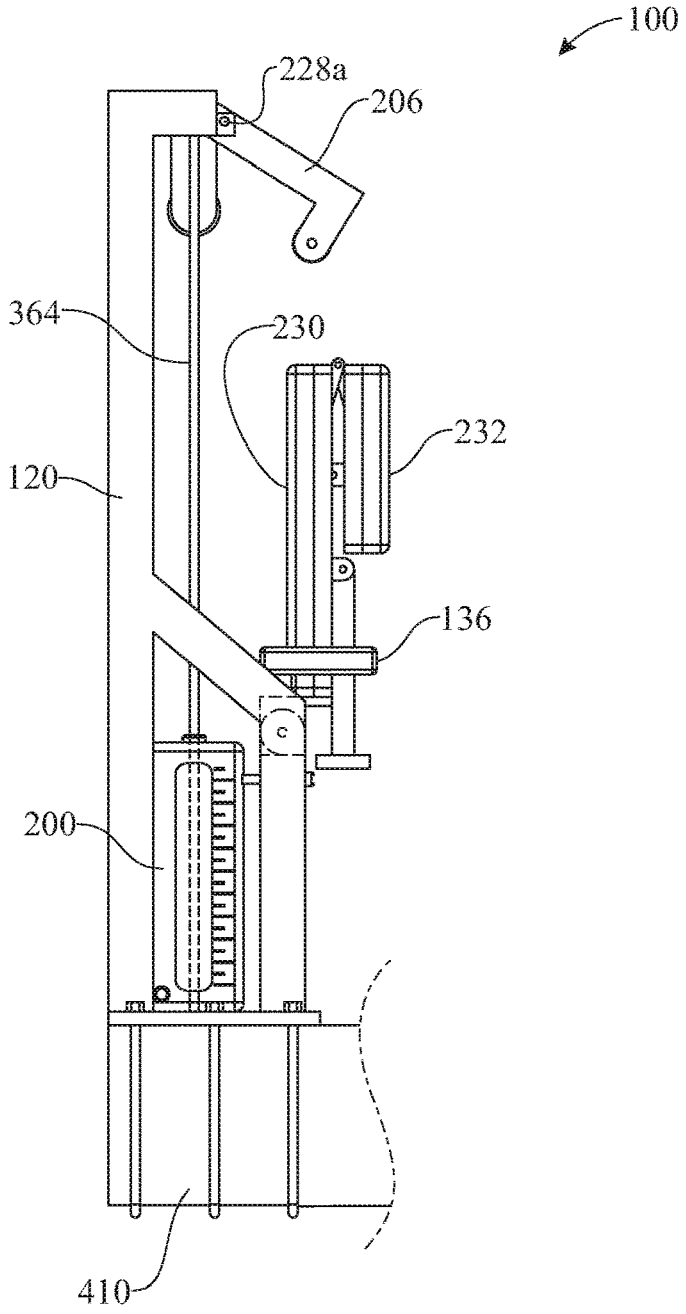
FIG. 7 presents a side elevation view, similar to FIG. 6, of the vehicle-mounted exercise system in a second or partially deployed position.
Figure 8:
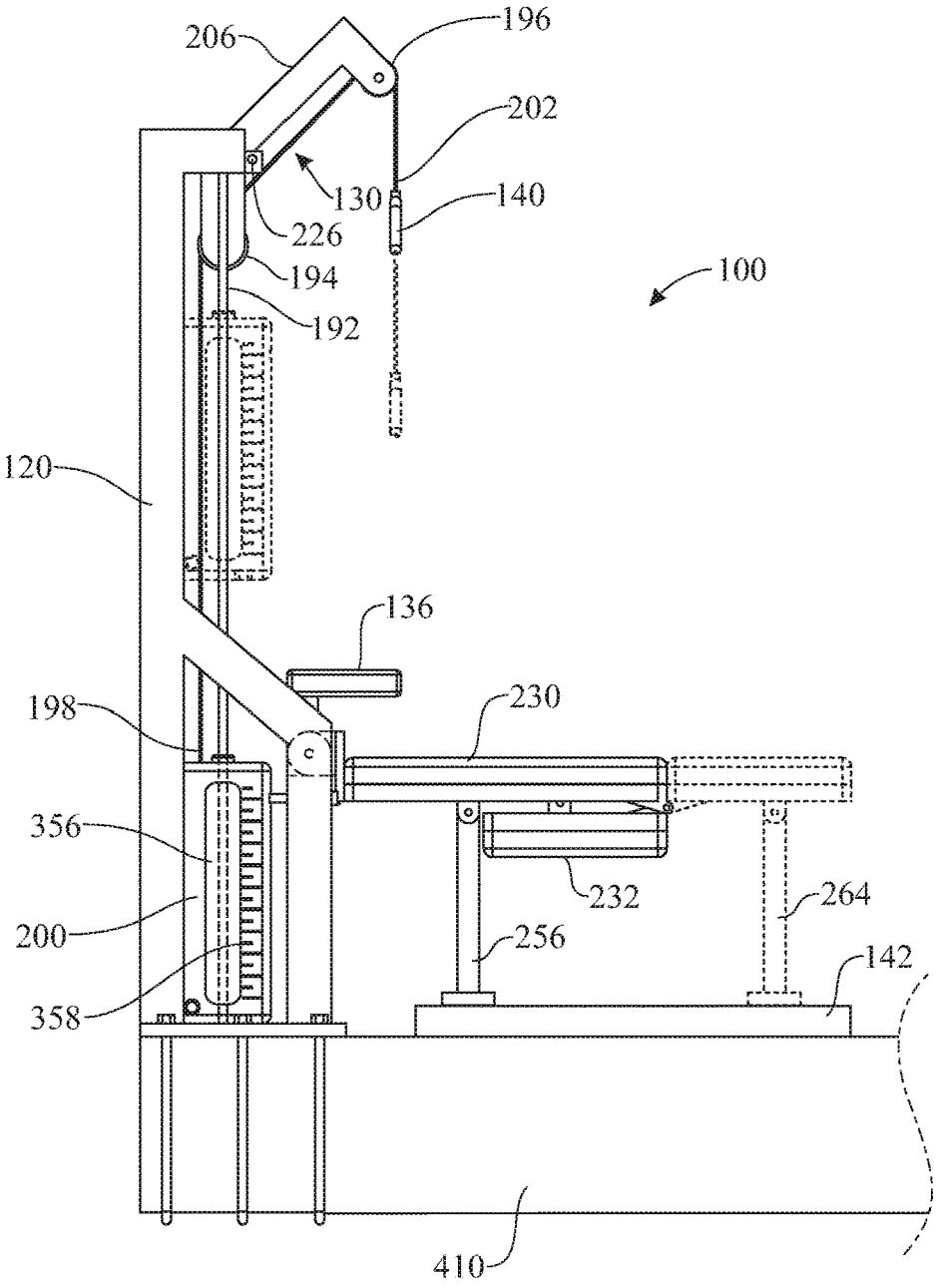
FIG. 8. presents a side elevation view, similar to FIG. 7, of the vehicle-mounted exercise system in a third or fully deployed position and ready for use.

The first pulley 194 extends downward from and is rotatably attached to the front cross-bar 170 of the main frame 120 while the second pulley 196 is rotatably mounted on an L-shaped extension arm 206. The second pulley 196 is rotatably mounted on a first end 208 of the extension arm 206 while a second end 210 of the extension arm 206 is pivotally mounted within a slot 212 formed in the front cross-bar 170. The first pulley 194 is suspended between downwardly extending ears 214 and 216 extending from the front cross-bar 170, and is rotatably mounted by a pin 218 extending between the ears 214 and 216. Similarly, the second pulley 196 is suspended between ears 220 and 222 extending from the first end 208 of the L-shaped extension arm 206 and rotatably supported therebetween by a pin 224. The second end 210 of the L-shaped extension arm 206 is pivotally mounted within the slot 212 on the front cross-bar 170. The slot 212, and thus the downward pressure on the first pulley 194, is centrally located along the front cross-bar 170 so as to evenly distribute the forces within the main frame 120. An axle 226 can be removably inserted into through holes 228*a* and 228*b* in order to provide a bottom support to the L-shaped extension arm 206 which keeps the L-shaped extension arm 206 in an elevated, operational position, shown in FIGS. 2 and 8. When not exercising, the user can remove the axle 226 from the through holes 228*a* and 228*b*, allowing the L-shaped extension arm 206 to pivot downward to a folded or storage position as shown in FIGS. 7 and 8. The through holes 228*a* and 228*b* are comprised in ears or protruding portions carried by the front cross-bar 170 near the slot 212.

As noted hereinabove, the exercise system 100 includes a seat assembly 134. The seat assembly 134 is movably and detachably mounted to the main frame 120 and generally includes a primary seat section 230 pivotally mounted to the frontal cross-bar 150 of the main frame 120 and a secondary seat section 232 pivotally mounted to the primary seat section 230. The primary seats section 230 includes a bottom plate 234 and a padded seat 236 mounted on the top of the bottom plate 234. Likewise, the secondary seat section 232 includes a bottom plate 238 and a padded seat 240 mounted on the bottom plate 238. The padded seats 236 and 240 are provided for the comfort of the user and aid in preventing the user from sliding off the seat assembly 234 during use.

The primary seat section 230 is centrally and pivotally mounted to the frontal cross-bar 150 by a clevis 242 extending from the bottom plate 234 of the primary seat section. The clevis 242 connects to an ear 244 extending from a center point 246 of the frontal cross-bar 150. A pivot pin 248 (FIG. 6) secures the clevis 242 about the ear 244. This pivotal connection between the clevis 242 and the ear 244 allows the seat assembly 134 to be pivotally raised relative to the main frame 120 for storage and lowered for use.

Likewise, as best seen in FIG. 6, the secondary seat section 232 is pivotally connected to the primary seat section 230 by respective mounting brackets 250, 252 and a pivot pin 254. With continued reference to FIGS. 3 and 6, the primary seat section 230 includes first support leg 256 pivotally connected to a first bracket 258 on an underside 260 of the bottom plate 234 by a pin 262 (FIG. 6) and the secondary seat section 232 includes a second support leg 264 connected to a second bracket 266 on an underside 268 of the bottom plate 238 by a pin 270 (FIG. 6).

Referring still to FIG. 3, the leg rests 136 and 138 include respective L-shaped rest sections 272, 274 and respective downwardly extending mounting shafts 276, 278. The mounting shafts 276 and 278 are adjustably received in mounting holes 280 and 282 formed through the frontal cross-bar 150. Pins 284 and 286 extend through the frontal cross-bar 150 and into adjustment holes 288 and 290 formed through the mounting shafts 276 and 278. Specifically, the pins 284 and 286 extend through holes 292 and 294 formed through the frontal cross-bar 150. When the pins 284, 286 are removed, the mounting shafts 276 and 278 can optionally be rotatable within the respective mounting holes 280 and 282, such as by having the mounting shafts and holes 276, 278, 280, 282 cylindrical in shape; this allows the leg rests 136, 138 to pivot horizontally inward and outward (i.e. about a respective vertical rotation axis coinciding with a respective central longitudinal axis of the mounting shafts 276 and 278).

The mounting system 122 generally includes U-shaped mounting brackets 296, 298, 300, 302, 304 and 306 each having respective threaded ends 308, 310, 312, 314, 316 and 318. Pairs of nuts, for example nuts 320, 322 and 324 are provided to secure the U-shaped mounting brackets 296, 298, 300, 302, 304 and 306 to holes 326, 328, 330 formed through the base plate 130.

Figure 4:
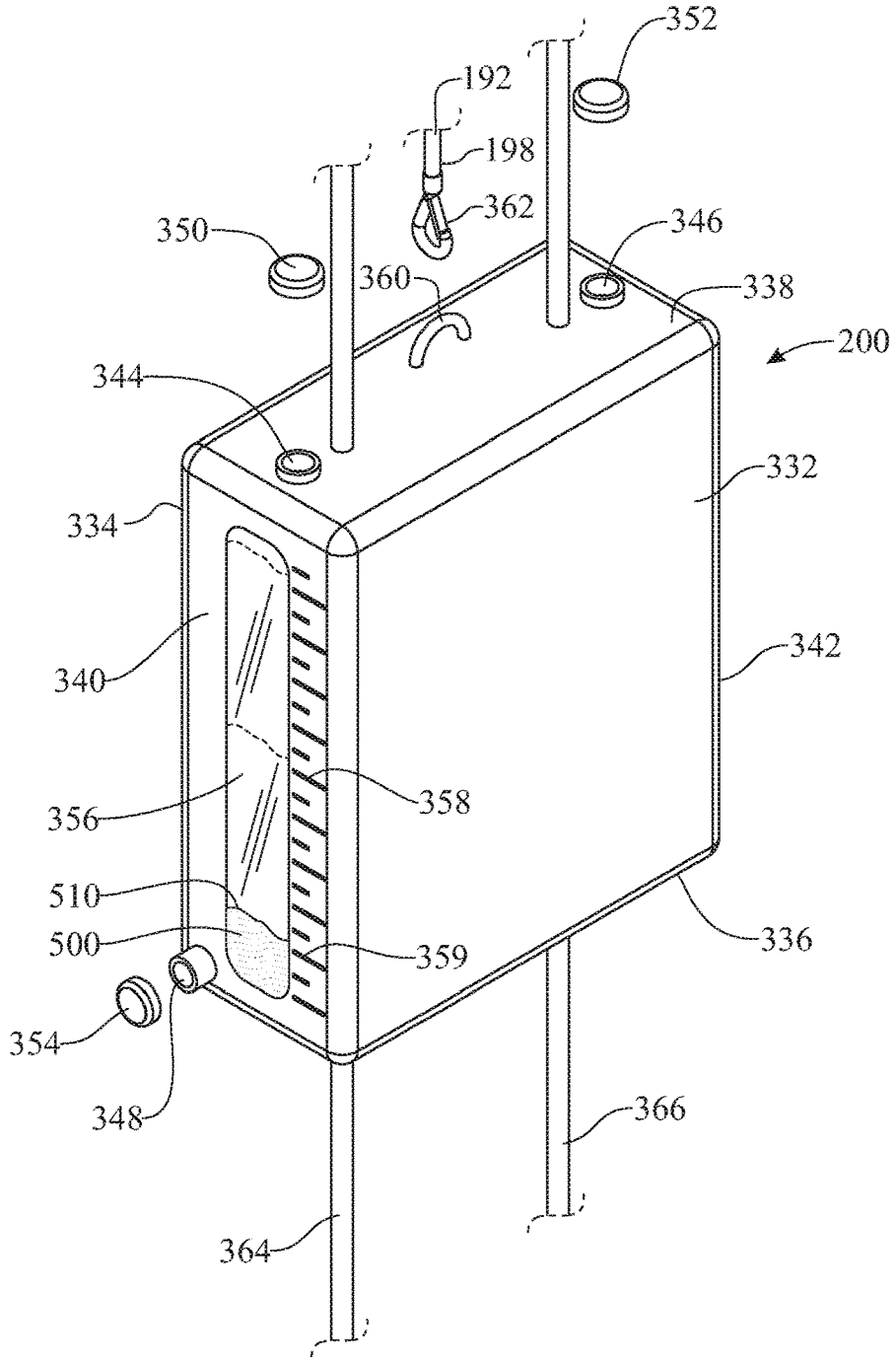
FIG. 4 presents an enlarged, isometric frontal view of a container of the vehicle-mounted exercise system.

Referring now to FIG. 4, the details of the container 200 of the exercise system 100 will now be described. The container 200 is hollow and has a front side 332, a back side 334, a bottom side 336, a top side 338, a first end side 340 and a second end side 342. The container 200 forms the adjustable weight portion of the exercise mechanism 130 and is configured to water-tightly receive a commonly available liquid, preferably water, to determine the weight of the container and thus the resistance provided to the user. The user may add a variable amount of liquid to the container 200 to adjust the weight as desired.

Alternatively or additionally, a variety of other pourable materials may be used to increase or decrease the weight contained in the container and thus the exercise resistance desired by the user. For instance and without limitation, solid pourable materials such as sand, small pebbles, or the like may be used.

Fill holes 344 and 346 are provided in a top portion of the container 200 to permit filling the container 200 with water or another content, to increase the weight of the container 200. In the present embodiment, the fill holes 344 and 346 are particularly located on the top side 338 of the container 200, to maximize the weight to which the container 200 can be loaded. In turn, a drain hole 348 is provided at a bottom portion of the container 200 to allow removal of the water or other content to decrease the weight of the container 200. In the present embodiment, the drain hole 348 is provided through a bottom edge a side (such as first end side 340) of the container 200, to facilitate opening and closing of the drain hole 348 by the user. Fill caps 350 and 352 are provided to seal the fill holes 344 and 346, respectively, while a drain cap 254 is provided to seal the drain hole 348 to maintain the water level within the container 200 and allow for easy draining to empty the system.

Preferably, the container 200 is formed from an opaque material and includes a transparent sight window 356 formed in one or both of the end sides, for example on first end side 340, to visually indicate the amount of water 500 in the container 200. Indicia 358 is provided on the first end side 340 adjacent the sight window 356 to act as measuring marks, which may be provided with numbers (not shown), calibrated to indicate the combined weight of the container 200 and water 500 contained therein, and thus inform the user of the weight he or she will be lifting when using the exercise system 100. Thus, the user can fill the container 200 with water 500 up to a specific water level 510 corresponding to a desired combined weight indicated by a corresponding specific marking 359 of the indicia 358.

As noted hereinabove, the detachable end 198 of the detachable cable 192 is removably attached to the container 200. As shown in FIG. 4, the container 200 includes a loop 360 on the top side 338 for attachment to a hook 362 provided on the detachable end 198 of the detachable cable 192. The hook 362 is removably secured to the loop 360 so that the lat bar 140 and detachable cable 192 may be removed from the exercise system 130 for storage and transportation. The hook 362 depicted in the drawings is a carabiner type of connector; those skilled in the art will understand that alternative types of hooks or other removable fasteners may be used to detachably connect the end of the detachable cable 192 to the container 200.

In order to stabilize the movement of the container 200 as it is pulled up and down by the detachable cable 192 during use and to prevent loss of the container 200 during transportation and storage, the exercise system 130 further includes vertical stabilizer rods 364 and 366 that extend between and are rigidly attached to the front cross-bar 170 and the base plate 132, as shown in FIG. 6. While not specifically shown, the vertical guide bars or stabilizer rods 364 and 366 can pass through tubes extending through the container 200 and between the top side 338 and the bottom side 336. The container 200 glides up and down along the vertical stabilizer rods 364 and 366 during use. This prevents the container 200 from rotating or otherwise moving off course during use while maintaining the water containing integrity of the container 200 when filled with water.

Figure 5:
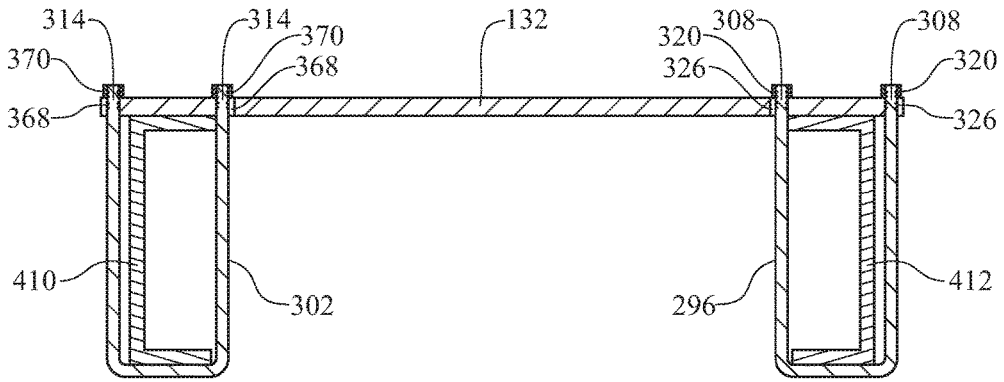
FIG. 5 presents a rear view, shown in section, of brackets of the vehicle-mounted exercise system used to mount the vehicle-mounted exercise system to a vehicle or truck of FIG. 2.

Turning now to FIGS. 2-8, and initially with regard to FIGS. 2, 3 and 5, the installation and use of the vehicle-mounted exercise system 100 will now be described. Initially, with regard to FIG. 2, the container 200 is empty and the detachable cable 192 and lat bar 140 are removed. The exercise system 100 is positioned on the rails 410 and 412 of the truck 400 such that the main frame 120 of the exercise system 100 is adjacent to the back wall 414 of the traveling quarters 408 of the cab 402.

With reference to FIGS. 3 and 5, the U-shaped mounting brackets, for example the U-shaped mounting brackets 296 and 302 are positioned around the rails 412 and 410 of the truck 400 and the base plate 132 is positioned on top of the rails 412 and 410. The threaded ends 308 and 314 of the mounting brackets 296 and 302 are inserted through the holes 326 of the base plate 132 and a similar set of holes 368 located on the opposite side of the base plate 132 and secured by means of nuts 320 and nuts 370, respectively. The nuts 320 and 370 are subsequently securely tightened to firmly clamp the mounting brackets 296 and 302 around the rails 412 and 410 of the truck 400 to thereby secure the exercise system 100 to the truck 400.

Turning now to FIG. 6, the exercise system 100 is shown in a first or storage and transportation position. In this first position, the seat assembly 134 is in a fully upright position and is held in place until use by L-shaped extension arm 206 as shown (for which the axle 226 has been removed from the holes 228*a*, 228*b*, allowing the L-shaped extension arm 206 to adopt a downward pivoted position). Alternatively or additionally, the L-shaped extension arm 206 may include a locking mechanism (not shown), such as a magnet, a pin, a lock, etc., to secure the seat assembly 134 in the upright position. Additionally, the first and second support legs 256 and 264 are in the initial position folded down against the primary and secondary seat sections 230 and 232, respectively. Further, the leg rests 136 and 138 are installed in the frontal cross-bar 150 in the orientation of FIG. 3, to further secure the seat assembly 134 in the upright first position. In this first position, the exercise system 100 is safely stowed for storage or transportation and the container 200 is generally not filled with water. The lat bar 140 and detachable cable 192 are removed and may be stored elsewhere, such as in the cab 402 of the truck 400.

Referring now to FIG. 7, when a user, such as a truck driver, wishes to make use of the exercise system 100, the L-shaped extension arm 206 can be pivoted up and away from the seat assembly 134 allowing the secondary seat section 232 to fold down to into a second or intermediary position. In this intermediary position, the leg rests 136 and 138 still maintain the primary seat section 230 in the upright position. Thereafter, the leg rests 136 and 138 may be temporarily removed or pivoted outward and the primary seat section 230 folded away from the main frame 120 to the third or final and fully deployed position as shown in FIG. 8. The first support leg 256 is pivoted down to rest on the non-slip floor 142 and support the primary seat section 230 for use. The leg rests 136 and 138 may then be reinstalled, or pivoted inward, and adjusted to a comfortable height prior to use, as shown in FIG. 8. Additionally, should extra length of the seat assembly 134 be needed, the secondary seat section 232 may be unfolded and the second support leg 264 lowered against the non-slip floor 142, as illustrated in broken lines in the figure.

Thereafter, the detachable cable 192 is put into position within the exercise mechanism 130 by threading the detachable end 198 of the detachable cable 192 over the second and first pulleys 196 and 194 and attaching the detachable end 198 of the detachable cable to the container 200. At this point, the exercise system 100 is set up for use. The user determines how much weight he or she wants to exercise with and adds the appropriate amount of water to the container 200 through the fill holes 344 and 346 (FIG. 4). The correct amount of water can be verified through the sight window 356 of the container 200 and against the indicia 358 marked thereon. The user can now stand or sit on the seat assembly 130 and pull down on the lat bar 140 to exercise his body in various positions. Pulling down the lat bar 140 will pull on the detachable cable 192, which in turn pulls upward on the container 200 and causes the container 200 to rise; for illustrative purposes, a lowered lat bar 140 and correspondingly raised container 200 have been illustrated in broken lines in FIG. 8 to depict the movement sequence of the exercise system 100.

After use, the water can be drained out of the container 200 through the drain hole 348 (FIG. 4), and the detachable cable 192 and lat bar 140 can be removed for storage. The seat assembly 134 can then be folded up against the main frame 120 and secured thereto for transportation by reversing the above procedure working from the third or fully deployed position of FIG. 8 back to the initial or first stored position of FIG. 6.

In this manner, the disclosed vehicle-mounted exercise system 100 provides a simple and easily adjustable weight training system for use on the road by long distance drivers to assist in maintain themselves in shape.

Figure 9:
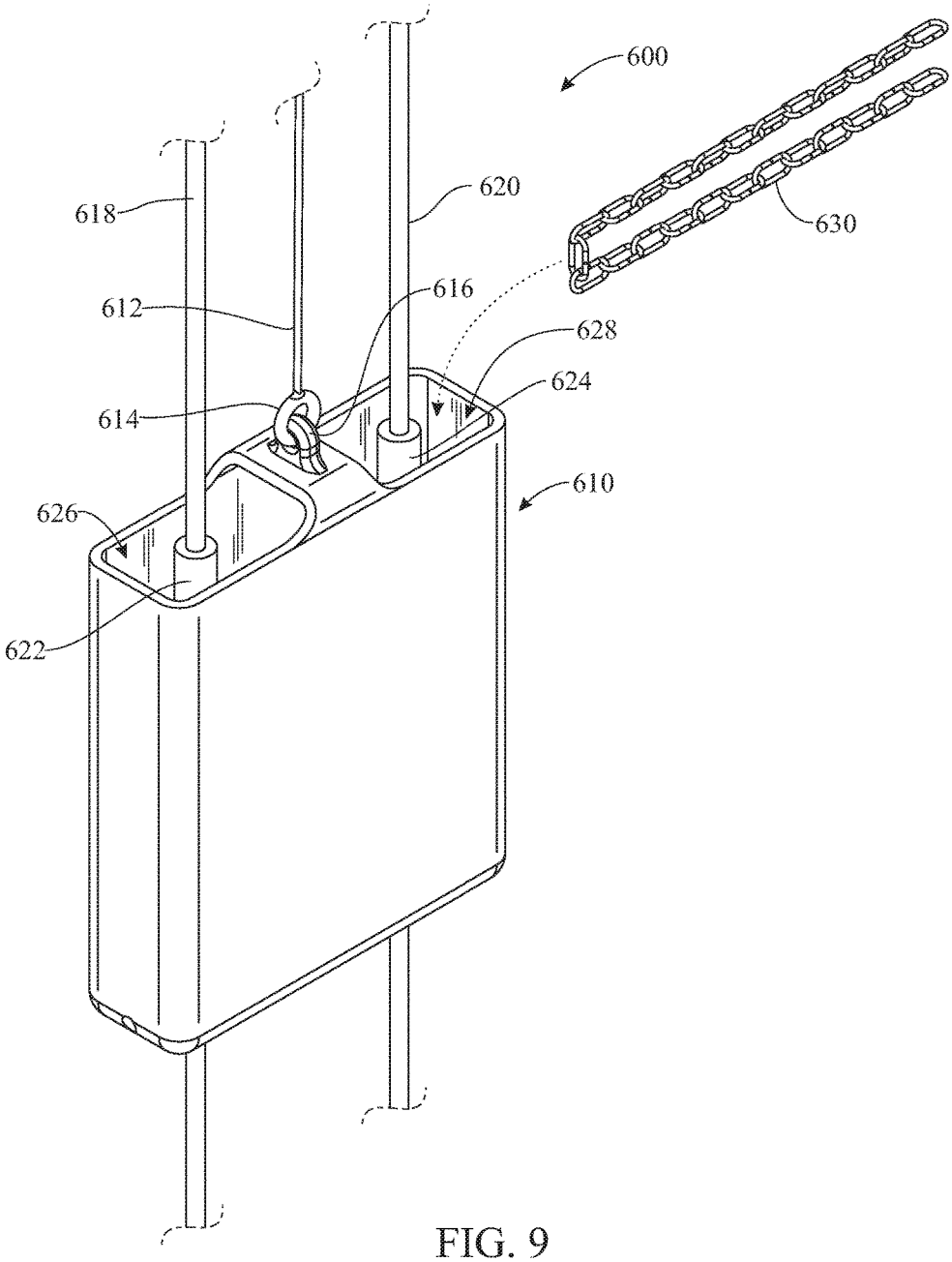
FIG. 9 presents an enlarged, isometric frontal view of the container of the vehicle-mounted exercise system of FIG. 1, being loaded with a vehicle wheel chain instead of with water.

The illustration of FIG. 9 shows a close-up view of a portion of a vehicle exercise system 600 in accordance with a second implementation of the invention. The vehicle exercise system 600 can be constructed exactly the same as the vehicle exercise system 100 of the previous embodiment, except as otherwise indicated hereinafter. As shown, the vehicle exercise system 600 includes a container 610 for counteracting a pulling force exerted by a user on a lat bar and a cable 612 (similarly to the container 200, lat bar 140 and detachable cable 192 of the previous embodiment). An end ring 614 carried by the cable 612 is engaged with a top loop 616 of the container 610 (similarly to the hook 362 and loop 360 connection of the previous embodiment). However, unlike the previous embodiment, the end ring 614 and top loop 616 of the present embodiment are permanently or non-disconnectably coupled to one another (nevertheless, alternative embodiments are contemplated in which they may be disconnected from one another as in the previous embodiment). Similarly to the previous embodiment, the container 610 is stabilized by two vertical stabilizer rods 618 and 620 which pass through two corresponding tubes 622 and 624 of the container 610, guiding the container 610 when moving vertically upward and downward.

Unlike the previous embodiment, the container 610 is open at a top area thereof, i.e. includes one or more openings allowing a user to insert and remove items to and from the container 610. For instance and without limitation, the container 610 is shown having two top openings 626, 628. As depicted in the drawing, a user can insert items such as a tire chain 630 into the container 610 to increase the overall weight of the container 610 and also store said items. Thus, the container 610 of the present embodiment serves a dual purpose: adjusting the resistance of the vehicle exercise system 600 and providing additional storage space within the vehicle. Preferably, the container 610 is opaque in order to conceal the items stored within the container 610.

Figure 10:
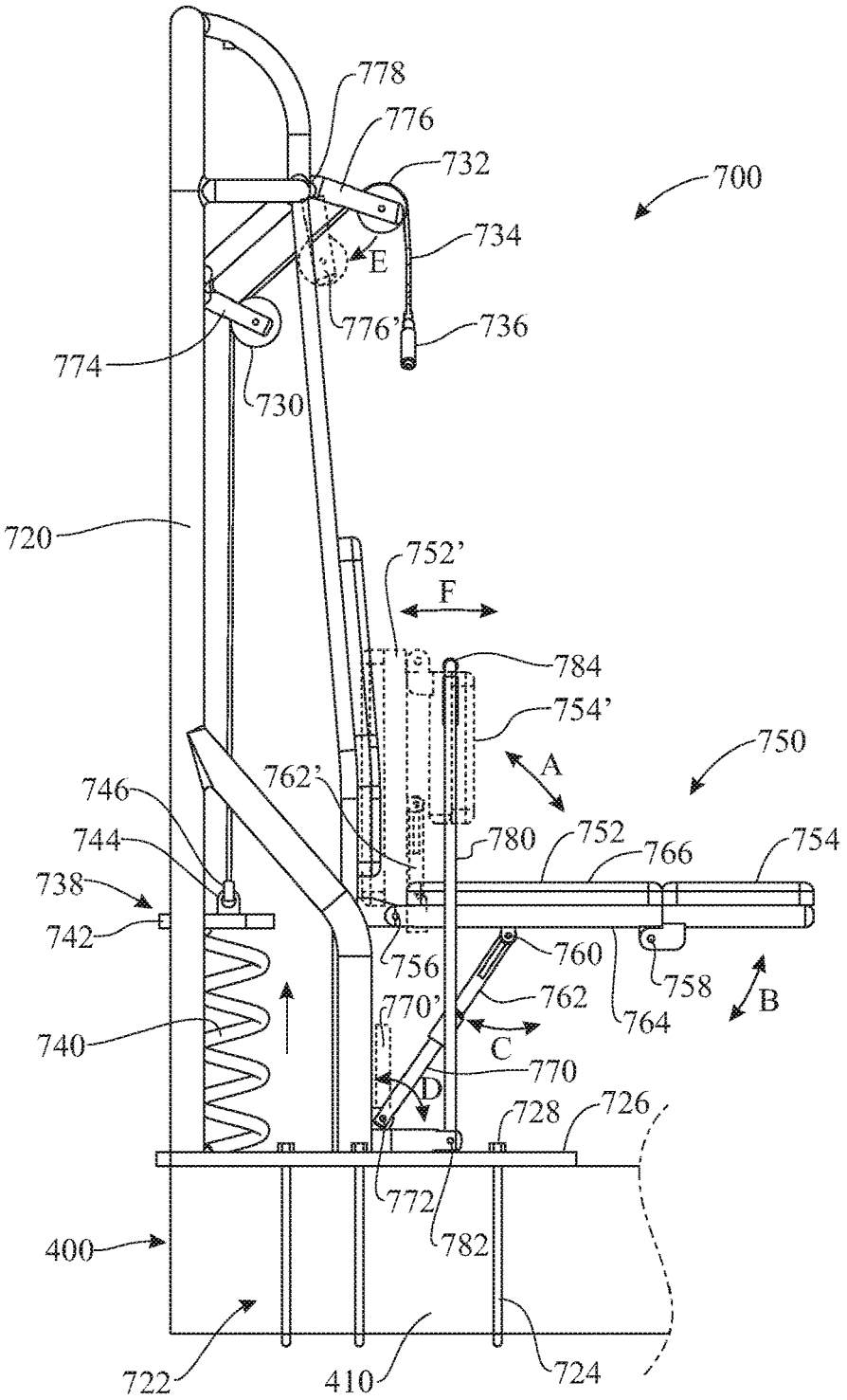
FIG. 10 presents a side elevation view of a vehicle-mounted exercise system in accordance with a second illustrative embodiment of the invention, shown in a fully deployed position and in operation.

The illustration of FIG. 10 shows a side elevation view of a vehicle exercise system 700 in accordance with a third implementation of the invention. Similarly to the vehicle exercise system 100 of the first embodiment, the vehicle exercise system 700 comprises a main frame 720 and a mounting system 722 for attaching main frame 720 to a vehicle (e.g., the truck 400 of FIGS. 1 and 2). The mounting system 722 can for instance include several U-shaped brackets 724 engaging the truck rails 410 and extending through a base plate 726 of the vehicle exercise system 700. A set of nuts 728 can tighten and secure the U-shaped brackets 724 against the truck rails 410 and the base plate 726.

Similarly to the previous embodiment, the main frame 720 carries two pulleys 730, 732 at a top area of the main frame 720. A cable 734 extends along the pulleys 730, 732. A first end of the cable 734 is secured to a lat bar 736 (similar to the lat bar 140 of FIG. 3). An opposite, second end of the cable 734 is disconnectably or non-disconnectably attached to a spring-biased system 738. The spring-biased system 738 comprises an extension spring 740, a bottom end of which is secured to the base plate 726. In turn, a top plate 742 is secured to a top end of the extension spring 740, the top plate 742 comprising a topward-oriented loop 744 for securing a ring 746 carried by the cable 734 at the second end thereof. When secured to the ring 746, the cable 734 can pull on the spring-biased system 738.

Also similarly to the previous embodiment, the vehicle exercise system 700 further includes a seat assembly 750 comprising a primary seat section 752 and a secondary seat section 754. The primary seat section 752 is pivotably attached to the main frame 720 by an articulated connection 756 that provides a horizontal, transverse rotation axis which allows the primary seat section 752 to pivot upward and downward relative to the main frame 720 as indicated by arrow A. In turn, the secondary seat section 754 is pivotably attached to the primary seat section 752 by an articulated connection 758 that provides a horizontal, transverse rotation axis which allows the secondary seat section 754 to pivot upward and downward relative to the primary seat section 752 as indicated by arrow B. Furthermore, the primary seat section 752 comprises an articulated connection 760 pivotably carrying a tube portion 762. The articulated connection 760 is arranged on a bottom side 764 of the primary seat section 752, opposite to a top side 766 of the primary seat section 752 which provides a seating surface for the user. The articulated connection 760 provides a horizontal, transverse rotation axis which allows the tube portion 762 to pivot upward and downward relative to the primary seat section 752 as indicated by arrow C.

In turn, a secondary tube portion 770 is pivotably carried by the main frame 720. As shown, an articulated connection 772 is provided at a bottom of the main frame 720, near the base plate 726, providing a horizontal, transverse rotation axis which allows the secondary tube portion 770 to pivot upward and downward relative to the main frame 720 as indicated by arrow D. In addition, the pulleys 730, 732 are carried by a respective arm 774, 776. The arms 774, 776 can be fixed or movable relative to the main frame 720. For instance, in the present embodiment, arm 774 is fixed whereas arm 776 is pivotable relative to an articulated connection 778 allowing to fold the arm downward in the direction of arrow E for storage purposes.

The vehicle exercise system 700 of the present embodiment further includes at least one hand-operable lever 780 which pivotably connected to the main frame 720 via a bottom articulated connection 782 that provides a horizontal, transverse rotation axis which allows the lever 780 to pivot forward and rearward relative to the main frame 720 as indicated by arrow F. The lever 780 can include a handle 784 to facilitate an ergonomic and non-slip gripping of the lever 780 by the user's hand. The lever 780 may be tensioned to provide a fixed or adjustable resistance to the user's manual operation of the lever 780, to promote muscle exercise when operating the lever 780.

In order to carry out an exercise routine, the user can pivot the primary and secondary seat sections 752, 754 to the extended position shown in solid lines, and engage the tube portion 762 with the secondary tube portion 770 such as in a male-female connection. The user can sit on the primary and/or secondary seat sections 752, 754, the tube portions 762, 770 jointly providing a bottom support for supporting the weight of the user and the seat sections 752, 754. The user can then proceed to cyclically pull on, and release pulling of the lat bar 736. When the user pulls the lat bar 736 downward, the extension spring 740 stretches and provides a resistance to the user's pulling force, increasing the effort required by the user to pull the lat bar 736 and thus allowing the user to exercise his or her muscles. When the user stops applying a downward pulling force on the lat bar 736, the pulling force exerted by the extension spring 740 on the cable 734 is capable of pulling the cable 734 downward, and thus of pulling the lat bar 736 upward back to an initial, more elevated position.

After finishing exercising, the user may manipulate the vehicle exercise system 700 to a storage position, shown in broken lines. Specifically, the user may fold arm 776 downward about its articulated connection 778 to a final position indicated by reference numeral 776'. The primary seat section 752 can be folded upward about the articulated connection 756 to a final, optionally vertical position indicated by reference numeral 752'; in this final position, the tube portion 762, which has become disengaged from the secondary tube portion 770, has pivoted about its articulated connection 760 to a final, hanging position indicated by reference numeral 762'. The user may then fold the secondary seat section 754 forward, about the articulated connection 758, to a final, optionally vertical position resting against the primary seat section 752 and indicated by reference numeral 754'. Finally, the user can fold the secondary tube portion 770 about its articulated connection 772 to a final, optionally vertical position as shown in the drawing (alternatively, the secondary tube portion 770 could be folded to a final, horizontal position or other alternative final position).

Further embodiments of the invention are contemplated in which a locker, cabinet or other container can enclose the vehicle exercise system in the folded, storage position. The locker, cabinet or container can be fixed to the vehicle or removable from the vehicle. When the vehicle is traveling, or parked, the driver can enclose the folded vehicle exercise system within the container to seal and protect the vehicle exercise system from potentially harmful environmental agents such as rain, snow, intense sun, or dust, for instance and without limitation, preventing the vehicle exercise system from deteriorating and keeping the system clean. The locker, cabinet or other container can be made of a lightweight material such as, but not limited to, aluminum or plastic.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A vehicle exercise system for use on a motor vehicle, the vehicle exercise system comprising:

a main frame;

a mounting system for securing said main frame to a portion of a motor vehicle;

a seat assembly providing a seating surface for a user of the vehicle exercise system;

at least one pulley, each pulley of said at least one pulley being carried by the main frame and individually rotatable relative to the main frame;

a cable portion; and a puller device; wherein a first end of the cable portion is attached to the puller device and an opposite, second end of the cable portion is attached to a bar, said cable portion passing over said at least one pulley in a reciprocally back-and-forth movable manner; and further wherein the puller device is configured to provide a resistance to an upward pulling of the cable portion on the puller device responsive to a pulling of the bar at the second end of the cable portion; and wherein the vehicle exercise system further comprises an extension arm pivotably carried by the main frame at a top area thereof, wherein a pulley of the at least one pulley is rotatably carried by the extension arm, and wherein the vehicle exercise system is configured to adopt a storage position in which the seat assembly is pivoted upward and locked in place by the extension arm.

2. The vehicle exercise system of claim 1, wherein the puller device comprises a hollow container suspended from the cable portion.

3. The vehicle exercise system of claim 2, wherein the container comprises a see-through window revealing a level of contents contained within the container.

4. The vehicle exercise system of claim 3, wherein the container comprises outer visible markings, wherein each marking is indicative of a respective total weight of the container and a corresponding specific water level of a specific amount of water contained within the container.

5. The vehicle exercise system of claim 2, wherein the container comprises at least one drain hole at or near a bottom side of the hollow container.

6. The vehicle exercise system of claim 1, wherein the vehicle exercise system is configured to adopt an operational position in which the seat assembly is pivoted downward relative to the storage position and provides a seating surface for the user of the vehicle exercise system.

7. The vehicle exercise system of claim 6, wherein, in the operational position of the vehicle exercise system, the extension arm is pivoted upward relative to the storage position.

8. The vehicle exercise system of claim 7, wherein, in the operational position of the vehicle exercise system, the extension arm is locked in place by an axle located beneath the extension arm and supporting the extension arm.

9. The vehicle exercise system of claim 8, wherein the axle is removable from underneath the extension arm.

10. The vehicle exercise system of claim 1, wherein the puller device comprises an extension-spring-biased system, the extension-spring-biased system secured between the main frame and the first end of the cable portion, the extension-spring-biased system configured to exert a pulling force on the first end of the cable portion responsive to a pulling force exerted by the first end of the cable portion on the extension-spring-biased system.

11. The vehicle exercise system of claim 1, wherein the puller device is disconnectably attached to the first end of the cable portion.

12. The vehicle exercise system of claim 1, wherein the puller device is non-disconnectably attached to the first end of the cable portion.

13. The vehicle exercise system of claim 1, wherein the seat assembly is pivotably attached to the main frame and configured to adopt a horizontal, seating position and to further adopt the storage position pivoted away from said seating position.

14. The vehicle exercise system of claim 1, wherein the seat assembly comprises a primary seat section pivotably attached to the main frame and a secondary seat section pivotably carried by the primary seat section.

15. The vehicle exercise system of claim 1, wherein the seat assembly comprises at least one pivotable bottom support, the bottom support configured to pivot relative to a seating portion of the seat assembly between an operational position in which the bottom support holds at least part of the weight of the seating portion and a storage position in which the bottom support is pivoted closer to the seating portion than in said operational position.

16. The vehicle exercise system of claim 1, wherein the mounting system comprises a U-shaped bracket for engaging a portion of a rail of a vehicle frame, the U-shape bracket attachable to the main frame of the vehicle exercise system for enclosing said portion of a rail therewithin and securing the vehicle exercise system to said portion of a rail.

* * * * *